US012637274B2

(12) United States Patent
Everett

(10) Patent No.: US 12,637,274 B2
(45) Date of Patent: May 26, 2026

(54) HIDDEN STORAGE BOX

(71) Applicant: Joseph Everett, Long Beach, CA (US)

(72) Inventor: Joseph Everett, Long Beach, CA (US)

( * ) Notice: Subject to any disclaimer, the term of this patent is extended or adjusted under 35 U.S.C. 154(b) by 61 days.

(21) Appl. No.: 18/883,821

(22) Filed: Sep. 12, 2024

(65) Prior Publication Data

US 2025/0091783 A1 Mar. 20, 2025

Related U.S. Application Data

(60) Provisional application No. 63/583,534, filed on Sep. 18, 2023.

(51) Int. Cl.

| | |
|---|---|
| ***B65D 77/04*** | (2006.01) |
| ***A45C 11/16*** | (2006.01) |
| ***B65D 77/22*** | (2006.01) |

(52) U.S. Cl.

CPC ..... *B65D 77/0486* (2013.01); *A45C 11/16* (2013.01); *B65D 77/22* (2013.01)

(58) Field of Classification Search

CPC ..... B65D 77/0486; B65D 77/22; A45C 11/16

See application file for complete search history.

(56) References Cited

U.S. PATENT DOCUMENTS

| | | | | | |
|---|---|---|---|---|---|
| 1,489,788 | A * | 4/1924 | Reid | A45D 33/22 | 132/296 |
| 1,518,594 | A * | 12/1924 | Marble | A45D 33/006 | 132/305 |
| 2,969,142 | A * | 1/1961 | Mack | A45D 40/065 | 220/822 |
| 4,965,951 | A * | 10/1990 | Miller | F41A 9/77 | 89/33.02 |
| 5,437,294 | A * | 8/1995 | Ebbets, III | A45D 40/22 | 206/823 |
| 10,172,434 | B2 * | 1/2019 | Lee | A45D 40/24 | |
| 10,526,131 | B2 * | 1/2020 | Kingswell | B65D 83/0454 | |
| 10,839,635 | B2 * | 11/2020 | Kingswell | G07F 13/02 | |
| 2008/0000493 | A1 * | 1/2008 | Anderson | A45D 33/22 | 132/295 |
| 2008/0116219 | A1 * | 5/2008 | Lawrence | G07F 11/54 | 221/265 |
| 2010/0051047 | A1 * | 3/2010 | Wang | A45D 33/008 | 132/301 |
| 2018/0370714 | A1 * | 12/2018 | Kingswell | B65D 3/08 | |

* cited by examiner

*Primary Examiner* — Andrew D Perreault

(74) *Attorney, Agent, or Firm* — Womble Bond Dickinson (US) LLP

(57) ABSTRACT

A hidden storage box includes: a base; an outer container on the base; and an inner container nested in the outer container on the base. The inner container is configured to rotate relative to the outer container in response to the base being rotated.

18 Claims, 2 Drawing Sheets

FIG. 7A
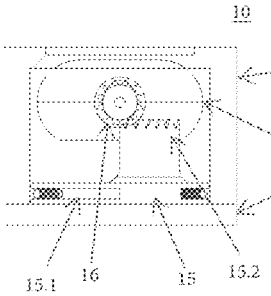
FIG. 7B
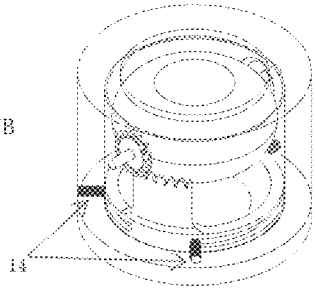
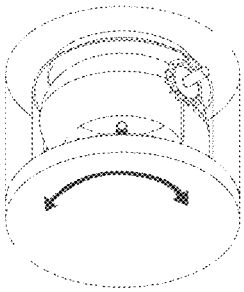
FIG. 12
FIG. 8A
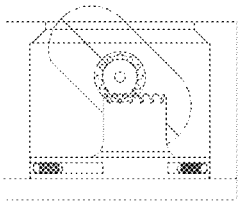
FIG. 8B
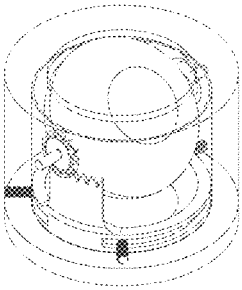
FIG. 9A
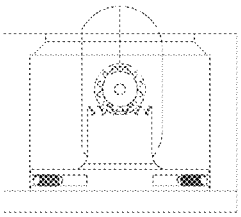
FIG. 9B
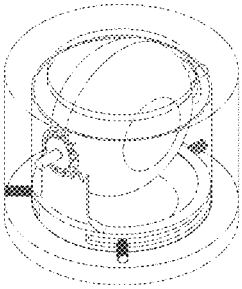
FIG. 10A
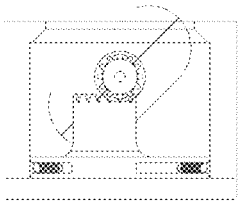
FIG. 10B
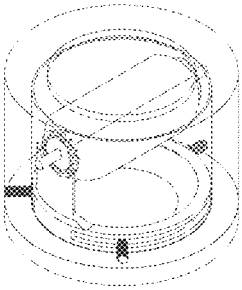
FIG. 11A
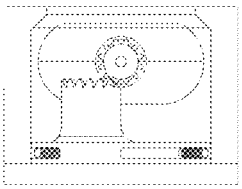
FIG. 11B
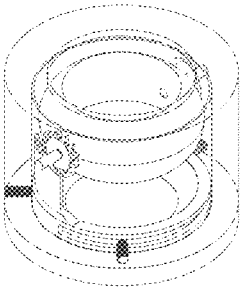

HIDDEN STORAGE BOX

CROSS-REFERENCE TO RELATED APPLICATION

The present application claims priority to and the benefit of U.S. Provisional Application No. 63/583,534, filed Sep. 18, 2023, the entire content of which is incorporated herein by reference.

BACKGROUND

1. Field

Aspects of embodiments of the present disclosure relate to a hidden storage box.

2. Description of the Related Art

Often, a decorative storage box is used to store and display higher end jewelry or other important or expensive items. This gives the item a more premium feel while also ensuring the that the item is protected during storage. However, such storage boxes often lack a cover or use a standard flip-type cover. While effective, these designs lack any premium feel and are obvious storage containers for often expensive items.

The above information disclosed in this Background section is for enhancement of understanding of the background of the present disclosure, and therefore, it may contain information that does not constitute related (or prior) art.

SUMMARY

Aspects of embodiments of the present disclosure are directed to a hidden storage box. For example, in some embodiments, the hidden storage box includes an outer container (e.g., an outer housing), a rotatable inner container, and a base. In use, an object to be stored (or hidden) is placed on or in a first surface of the rotatable inner container, then the base is rotated relative to the outer container (or the outer container is rotated relative to the base), which causes the inner container to rotate axially so that the first surface of the inner container moves from facing upwardly out of the outer container to facing downwardly into the outer container. In this manner, the object stored on or in the first surface of the inner container is then hidden by the outer container and a second surface of the inner container.

A hidden storage box, according to an embodiment of the present disclosure, includes: a base; an outer container on the base; and an inner container nested in the outer container on the base. The inner container is configured to rotate relative to the outer container in response to the base being rotated.

The hidden storage box may further include a rotation frame fixed to the base inside the outer container.

The rotation frame may include gear teeth at a distal end thereof, and the inner container may include a gear connected to the gear teeth of the rotation frame.

The gear teeth may be linear gear teeth, and the gear on the inner container may be a circular gear.

The rotation frame may have a groove formed therein, and the outer container may be rotatably connected to the rotation frame by a mechanical fastener extending through the outer container into the groove in the rotation frame.

The groove in the rotation frame may extend parallel to rotation direction of the base.

The gear may be fixed to the inner container and may be rotatably connected to the outer container.

The inner container may be configured to rotate relative to the outer container due to the gear teeth on the rotation frame rotating the gear as the base is rotated relative to the outer container.

The inner container may have an accommodation space therein.

In a first state, the accommodation space may face toward the base, and in a second state, the accommodation spaces may face away from the base.

A hidden storage box, according to another embodiment of the present disclosure, includes: a base; a rotation frame fixed to the base; an inner container rotatably coupled to the rotation frame; and an outer container rotatable coupled to the base and accommodating the rotation frame and the inner container therein. The inner container is rotatably coupled to the outer container.

The hidden storage box may further include a gear fixed to the inner container and rotatably coupled to the outer container.

The rotation frame may include linear gear teeth in contact with the gear, and as the base is rotated relative to the outer container, the gear fixed to the inner container may move along the linear gear teeth to rotate the inner container.

The hidden storage box may further include a mechanical fastener fixed to and extending through the outer container into groove in the rotation frame.

The groove may extend in a linear shape parallel to the linear gear teeth, and a length of the groove may control the maximum rotation of the outer container relative to the base.

An accommodation space in the inner container may face into the outer container in a first state, and the accommodation space in the inner container may face out of the outer container in a second state.

In the first state, the gear may be at one end of the linear gear teeth, and in the second state, the gear may be at an opposite end of the linear gear teeth.

The rotation frame may include two sets of the linear gear teeth at opposite sides of the inner container, the gear may be a first gear, a second gear may be fixed to the inner container at an opposite side of the inner container as the first gear, and the first gear may be connected to a first one of the two sets of linear gear teeth and the second gear may be connected to a second one of the two sets of linear gear teeth.

The outer container and the base may have the same diameter.

The outer container and the base may have the same width.

BRIEF DESCRIPTION OF THE DRAWINGS

These and other aspects and features of the present disclosure will be further appreciated and better understood with reference to the specification, claims, and appended drawings, in which:

FIGS. 7A, 8A, 9A, 10A, and 11A respectively correspond to FIGS. 1A, 2A, 3A, 4A, and 5A showing the hidden storage box in phantom lines;

FIGS. 7B, 8B, 9B, 10B, and 11B respectively correspond to FIGS. 7A, 8A, 9A, 10A, and 11A showing a perspective view of the hidden storage box in phantom lines; and FIG. 12 corresponds to FIG. 6 but shows the hidden storage box in phantom lines.

DETAILED DESCRIPTION

Figure 1A:
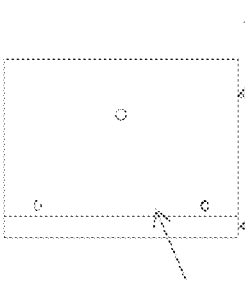
FIGS. 1A, 2A, 3A, 4A, and 5A show a side view of a hidden storage box in various configurations according to an embodiment of the present disclosure.

The detailed description set forth below is intended as a description of example embodiments of the present disclosure and is not intended to represent the only forms in which the present disclosure may be embodied. The description sets forth aspects and features of the present disclosure in connection with the illustrated example embodiments. It is to be understood, however, that the same or equivalent aspects and features may be accomplished by different embodiments, and such other embodiments are encompassed within the spirit and scope of the present disclosure. As noted elsewhere herein, like reference numerals in the description and the drawings are intended to indicate like elements. Further, descriptions of features, configurations, and/or other aspects within each embodiment should typically be considered as available for other similar features, configurations, and/or aspects in other embodiments.

It will be understood that when an element or layer is referred to as being "on," "connected to," or "coupled to" another element or layer, it may be directly on, connected, or coupled to the other element or layer or one or more intervening elements or layers may also be present. When an element or layer is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements.

In the figures, dimensions of the various elements, layers, etc. may be exaggerated for clarity of illustration. The same reference numerals designate the same elements. As used herein, the term "and/or" includes any and all combinations of one or more of the associated listed items. Further, the use of "may" when describing embodiments of the present disclosure relates to "one or more embodiments of the present disclosure." Expressions, such as "at least one of" and "any one of," when preceding a list of elements, modify the entire list of elements and do not modify the individual elements of the list. For example, the expression "at least one of a, b, or c" indicates only a, only b, only c, both a and b, both a and c, both b and c, all of a, b, and c, or variations thereof. As used herein, the terms "use," "using," and "used" may be considered synonymous with the terms "utilize," "utilizing," and "utilized," respectively. As used herein, the terms "substantially," "about," and similar terms are used as terms of approximation and not as terms of degree, and are intended to account for the inherent variations in measured or calculated values that would be recognized by those of ordinary skill in the art.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

The terminology used herein is for the purpose of describing embodiments of the present disclosure and is not intended to be limiting of the present disclosure. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

A person of ordinary skill in the art would appreciate, in view of the present disclosure in its entirety, that each suitable feature of the various embodiments of the present disclosure may be combined or combined with each other, partially or entirely, and may be technically interlocked and operated in various suitable ways, and each embodiment may be implemented independently of each other or in conjunction with each other in any suitable manner unless otherwise stated or implied.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

Figure 1B:
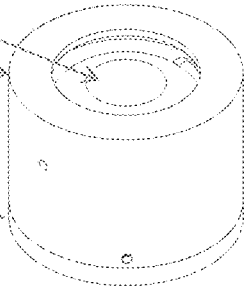
FIGS. 1B, 2B, 3B, 4B, and 5B respectively correspond to FIGS. 1A, 2A, 3A, 4A, and 5A and show a perspective view of the hidden storage box.
Figure 6:
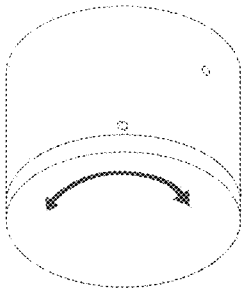
FIG. 6 is a bottom perspective view of the hidden storage box shown in FIGS. 1A-5B with an arrow showing the rotation of a base thereof.
Figure 2A:
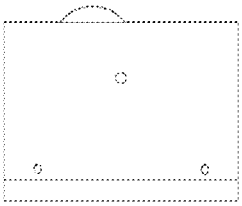
Figure 2B:
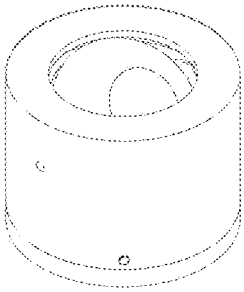
Figure 3A:
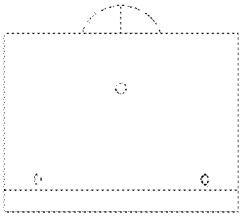
Figure 3B:
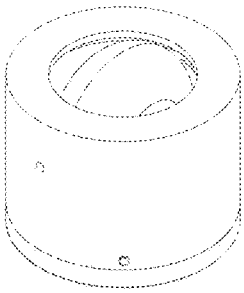
Figure 4A:
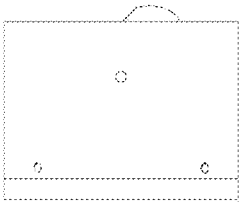
Figure 4B:
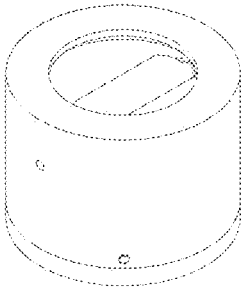
Figure 5A:
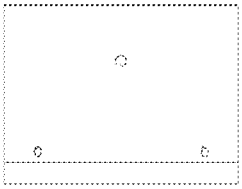
Figure 5B:
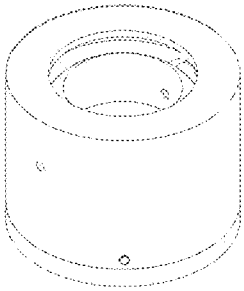

Referring to FIGS. 1A-12, a hidden storage box 10 according to an embodiment of the present disclosure is shown. Referring first to FIGS. 1A-6, which show an outer appearance of the hidden storage box 10, the hidden storage box 10 includes an outer container (e.g., an outer housing) 11, a base 12, and an inner container 13. The outer container 11, the base 12, and the inner container 13 may be made of the same materials or of different materials, such as wood, composite, plastic, vinyl, metal, etc.

In the illustrated embodiment, the hidden storage box 10 is generally cylindrical, but the present disclosure is not limited thereto. In other embodiments, the hidden storage box 10 may have different shapes, such as square, rectangular, pentagonal, etc. As will be understood based on the below disclosure, in embodiments in which the hidden storage box 10 is non-circular, a rotation mechanism of the inner container 13 may be configured such that a ¼ or ½ turn of the outer container 11 relative to the base 12 (or vice versa) (see, e.g., FIG. 6) is sufficient to rotate the inner container 13 to hide/expose an object thereon (e.g., to rotate the inner container 13 by about 180 degrees).

Referring to FIGS. 7A-12, the hidden storage box 10 is shown in phantom lines such that interior components are visible. Referring to FIGS. 7A-12, the hidden storage box 10 further includes a rotation mechanism, which is generally hidden from view by a user. The rotation mechanism may include a rotation frame 15 on or in the outer container and fixed to the base 12 and a rotating gear 16 fixed to inner container 13. The rotation frame 15 may include a protruding portion having a gear teeth at its distal end and configured to interface with the rotating gear 16. In the illustrated embodiment, the rotating mechanism is illustrated as being a face gear, but the present disclosure is not limited thereto. In other embodiments, the rotating mechanism may be a bevel gear, a rack and pinion actuator, etc.

In one embodiment, the hidden storage box 10 also includes a plurality of mechanical fasteners (e.g., set screws, pins, injection molded protrusion formed separately from or integrally with the outer container 11, etc.) 14, which extend through the outer container 11 and extend into one or more corresponding grooves 15.1 in the rotation frame 15. The mechanical fasteners 14 prevent lateral separation of the outer container 11 and the base 12 while allowing for rotation to occur therebetween. In an embodiment in which the mechanical fasteners 14 are set screws, the set screws are threaded through the outer container 11. In another embodiment in which the mechanical fasteners 14 are pins (e.g., hidden pins), the pins extend through the outer container 11 may be fixed thereto with, for example, an adhesive. The mechanical fasteners 14 are not limited as long as they allow for rotational movement while preventing vertical separation of the components.

Hereinafter, operation of the rotation mechanism will be described in more detail. FIGS. 7A and 7B show the hidden storage box 10 in a first (or hidden) configuration in which a cavity in the inner container 13 faces downwardly (e.g., faces into the outer container 11). In this first configuration, an object in the cavity in the inner container 13 is hidden from view by the outer container 11 and the bottom of the inner container 13, which faces upwardly out of the inner container 13.

Referring to FIGS. 8A-11B and 12, the rotation of the inner container 13 from the first configuration to a second configuration in which the cavity in the inner container 13 faces upwardly is shown. In the second configuration (see, e.g., FIGS. 11A and 11B), an object in the cavity in the inner container 13 is visible to a user because it is exposed through the upper end of the outer container 11.

Referring to FIGS. 8A-11B and 12, to expose the cavity in the inner container 13, a user rotates the outer container 11 relative to the base 12 (or vice versa). For example, when the hidden storage box 10 is placed on a surface, the user may rotate (e.g., may twist) the outer container 11 while the base 12 does not rotate due to friction with the surface.

As the outer container 11 rotates, the inner container 13 is also rotated (e.g., is rotated on a plane parallel to the base 12) due to an axle (or pin) extending through rotating gear 16 into a recess in the outer container 11. For example, the recess in the outer container 11 may be a bearing surface along which the axle can easily rotate. As the inner container 13 is moved, the rotating gear 16 is rotated due to movement along the gear teeth on the protruding portion 15.2 of the rotation frame 15. As the outer container 11 is farther rotated, the inner container 13 is moved farther along the gear teeth on the protrusion portion 15.2 and the inner container 13 rotates (e.g., rotates about an axis on the plane parallel to the base 12). For example, the rotating gear 16 may be rotatably coupled to the outer container 11 to freely rotate relative to the outer container 11 but may be fixed to the inner container 13 to rotate the same (e.g., to cause the inner container 13 to rotate as the rotating gear 16 rotates along the gear on the protruding portion 15.2). As this same time, the mechanical fasteners 14 move along the grooves 15.1 in the rotation frame 15 to ensure that the base 12 and the outer container 11 remain connected together.

Eventually, the mechanical fasteners 14 reach an opposite end of the groove and rotation of the outer container 11 relative to the base 12 is stopped. At this point, the inner container has rotated about 180 degrees such that the cavity therein faces upwardly, thereby revealing the object in the cavity in the inner container 13.

Then, the above-described process can be repeated in reverse to hide the cavity in the inner container 13 and the process is repeated. In this manner, the hidden storage box 10 can be used repeatedly, either for secure storage of a particular object (e.g., jewelry) or to surprise users with various different objects.

Although an embodiment of a hidden storage box has been described and illustrated herein, many modifications and variations within the embodiment will be apparent to those skilled in the art. Accordingly, it is to be understood that a hidden storage box according to the present disclosure may be embodied in forms other than as described herein without departing from the spirit and scope of the present disclosure.

What is claimed is:

1. A hidden storage box comprising:

a base;

an outer container on the base;

an inner container nested in the outer container on the base; and a rotation frame fixed to the base inside the outer container, the rotation frame comprising gear teeth at a distal end thereof, wherein the inner container is configured to rotate relative to the outer container in response to the base being rotated, wherein the inner container comprises a gear connected to the gear teeth of the rotation frame, wherein the rotation frame has a groove formed therein, and wherein the outer container is rotatably connected to the rotation frame by a mechanical fastener extending through the outer container into the groove in the rotation frame.

2. The hidden storage box according to claim 1, wherein the gear teeth are linear gear teeth, and wherein the gear on the inner container is a circular gear.

3. The hidden storage box according to claim 1, wherein the groove in the rotation frame extends parallel to rotation direction of the base.

4. The hidden storage box according to claim 1, wherein the gear is fixed to the inner container and is rotatably connected to the outer container.

5. The hidden storage box according to claim 4, wherein the inner container is configured to rotate relative to the outer container due to the gear teeth on the rotation frame rotating the gear as the base is rotated relative to the outer container.

6. The hidden storage box according to claim 5, wherein the inner container has an accommodation space therein.

7. The hidden storage box according to claim 6, wherein, in a first state, the accommodation space faces toward the base, and wherein, in a second state, the accommodation spaces faces away from the base.

8. A hidden storage box comprising:

a base;

a rotation frame fixed to the base;

an inner container rotatably coupled to the rotation frame; and an outer container rotatable coupled to the base and accommodating the rotation frame and the inner container therein;

a gear fixed to the inner container and rotatably coupled to the outer container; and a mechanical fastener fixed to and extending through the outer container into a groove in the rotation frame, wherein the inner container is rotatably coupled to the outer container, wherein the rotation frame comprises linear gear teeth in contact with the gear, wherein, as the base is rotated relative to the outer container, the gear fixed to the inner container moves along the linear gear teeth to rotate the inner container, wherein the groove extends in a linear shape parallel to the linear gear teeth, and wherein a length of the groove controls the maximum rotation of the outer container relative to the base.

9. The hidden storage box according to claim 8, wherein an accommodation space in the inner container faces into the outer container in a first state, and wherein the accommodation space in the inner container faces out of the outer container in a second state.

10. The hidden storage box according to claim 8, wherein the rotation frame comprises two sets of the linear gear teeth at opposite sides of the inner container, wherein the gear is a first gear, wherein a second gear is fixed to the inner container at an opposite side of the inner container as the first gear, and wherein the first gear is connected to a first one of the two sets of linear gear teeth and the second gear is connected to a second one of the two sets of linear gear teeth.

11. The hidden storage box according to claim 8, wherein the outer container and the base have the same diameter.

12. The hidden storage box according to claim 8, wherein the outer container and the base have the same width.

13. A hidden storage box comprising:

a base;

a rotation frame fixed to the base;

an inner container rotatably coupled to the rotation frame;

an outer container rotatable coupled to the base and accommodating the rotation frame and the inner container therein; and a gear fixed to the inner container and rotatably coupled to the outer container wherein the inner container is rotatably coupled to the outer container, wherein the rotation frame comprises linear gear teeth in contact with the gear, and wherein, as the base is rotated relative to the outer container, the gear fixed to the inner container moves along the linear gear teeth to rotate the inner container, wherein an accommodation space in the inner container faces into the outer container in a first state, wherein the accommodation space in the inner container faces out of the outer container in a second state, wherein, in the first state, the gear is at one end of the linear gear teeth, and wherein, in the second state, the gear is at an opposite end of the linear gear teeth.

14. The hidden storage box according to claim 13, further comprising a mechanical fastener fixed to and extending through the outer container into groove in the rotation frame.

15. The hidden storage box according to claim 14, wherein the groove extends in a linear shape parallel to the linear gear teeth, and wherein a length of the groove controls the maximum rotation of the outer container relative to the base.

16. The hidden storage box according to claim 13, wherein the rotation frame comprises two sets of the linear gear teeth at opposite sides of the inner container, wherein the gear is a first gear, wherein a second gear is fixed to the inner container at an opposite side of the inner container as the first gear, and wherein the first gear is connected to a first one of the two sets of linear gear teeth and the second gear is connected to a second one of the two sets of linear gear teeth.

17. The hidden storage box according to claim 13, wherein the outer container and the base have the same diameter.

18. The hidden storage box according to claim 13, wherein the outer container and the base have the same width.

* * * * *